US010240441B2

(12) United States Patent
Geerts et al.

(10) Patent No.: US 10,240,441 B2
(45) Date of Patent: Mar. 26, 2019

(54) OILFIELD PERFORATOR DESIGNED FOR HIGH VOLUME CASING REMOVAL

(71) Applicant: OWEN OIL TOOLS LP, Houston, TX (US)

(72) Inventors: Shaun Geerts, Crowley, TX (US); James Kinsey, Crowley, TX (US); Matthew C. Clay, Burleson, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 227 days.

(21) Appl. No.: 15/285,228

(22) Filed: Oct. 4, 2016

(65) Prior Publication Data

US 2017/0096883 A1 Apr. 6, 2017

Related U.S. Application Data

(60) Provisional application No. 62/237,302, filed on Oct. 5, 2015.

(51) Int. Cl.

| | |
|---|---|
| ***E21B 31/00*** | (2006.01) |
| ***F42B 1/028*** | (2006.01) |
| ***E21B 43/117*** | (2006.01) |
| ***E21B 43/119*** | (2006.01) |

(52) U.S. Cl.

CPC ..... *E21B 43/117* (2013.01); *E21B 31/002* (2013.01); *E21B 43/119* (2013.01); *F42B 1/028* (2013.01)

(58) Field of Classification Search

CPC .... E21B 43/117; E21B 43/119; E21B 31/002; F42B 1/028; F42B 3/08; F42B 3/24

See application file for complete search history.

(56) References Cited

U.S. PATENT DOCUMENTS 2,629,325 A * 2/1953 Sweetman ..... F42B 3/08 102/310
2,796,833 A * 6/1957 Sweetman ..... E21B 43/116 102/306
3,094,930 A 6/1963 Blair
(Continued)

FOREIGN PATENT DOCUMENTS

CA 1166954 A 5/1984
DE 3900269 A1 7/1990
(Continued)

OTHER PUBLICATIONS

PCT/US2016/055482—PCT Search Report dated Dec. 19, 2016.

*Primary Examiner* — Blake E Michener
(74) *Attorney, Agent, or Firm* — Mossman, Kumar & Tyler PC

(57) ABSTRACT

A perforating tool includes a charge holder connected to a work string and a perforator fixed in a charge holder disposed along the work string. The perforator includes a cylindrical case, an explosive material, a metal cap, and a detonating cord. The case has a bulkhead at a first end, an open mouth at a second end, and an interior volume. The first end includes a post having a slot. The explosive material is disposed in the interior volume. The metal cap covers the open mouth of the case and has a disk section defined by a separator ring. The separator ring has a structurally weakened zone that encircles the disk section. The detonating cord is received in the slot of the post.

14 Claims, 3 Drawing Sheets

(56) References Cited

U.S. PATENT DOCUMENTS 3,233,688 A 2/1966 Bell
3,244,101 A * 4/1966 Bell ..... C06C 7/00 102/310
3,245,485 A 4/1966 Bell
3,415,321 A 12/1968 Venghiattis
4,342,261 A * 8/1982 Majerus ..... F42B 33/0207 102/307
4,354,433 A 10/1982 Owen
4,590,861 A * 5/1986 Bugiel ..... F42B 1/028 102/307
4,627,353 A * 12/1986 Chawla ..... F42B 1/02 102/307
4,881,445 A * 11/1989 Hayes ..... E21B 43/117 102/306
4,951,572 A * 8/1990 Bocker ..... F42B 1/02 102/307
5,460,095 A * 10/1995 Slagle ..... E21B 43/117 102/307
5,698,814 A 12/1997 Parsons et al.
6,349,649 B1 * 2/2002 Jacoby ..... F42B 1/028 102/306
6,505,559 B1 1/2003 Joslin et al.
6,644,099 B2 11/2003 Bell
6,752,085 B2 * 6/2004 Roach ..... F42B 39/14 102/481
6,792,866 B2 9/2004 Grattan
7,073,448 B2 * 7/2006 Bell ..... E21B 29/02 102/306
7,661,367 B2 2/2010 Yang et al.
8,033,224 B1 10/2011 Yelverton
8,561,683 B2 10/2013 Wood et al.
9,428,979 B2 8/2016 Bell et al.
9,574,416 B2 2/2017 Wright et al.
2006/0075888 A1 * 4/2006 Yang ..... F42B 3/08 89/1.14

FOREIGN PATENT DOCUMENTS

EP 1367354 A1 12/2003
FR 1231003 A 9/1960
GB 2319592 A 5/1998

* cited by examiner

OILFIELD PERFORATOR DESIGNED FOR HIGH VOLUME CASING REMOVAL

CROSS REFERENCE TO RELATED APPLICATIONS

This application claims priority from U.S. Provisional Application Ser. No. 62/237,302, filed Oct. 5, 2015, the entire disclosure of which is incorporated herein by reference in its entirety.

TECHNICAL FIELD

The present disclosure relates to devices and methods for subsurface perforating.

BACKGROUND

Hydrocarbons, such as oil and gas, are produced from cased wellbores intersecting one or more hydrocarbon reservoirs in a formation. These hydrocarbons flow into the wellbore through perforations in the cased wellbore. A number of wellbore tubulars may be used in a wellbore in addition to casing. Such tubulars including liners, production tubing, and drill pipe. In some situations, it may be desirable to sever a portion of a wellbore tubular. For example, a drill pipe may become stuck in a wellbore. Removal of the drill pipe may require cutting the drill pipe into two sections. In another example, pipe may need to cut during well abandonment.

The present disclosure addresses the continuing need for perforators useful for subsurface operations that may take place during the construction, completion, workover, and/or de-commissioning of a well.

SUMMARY

In aspects, the present disclosure provides a perforator for perforating a wellbore tubular in a wellbore. The perforator may include a cylindrical case having a bulkhead at a first end, an open mouth at a second end, and an interior volume; an explosive material disposed in the interior volume; and a cap covering the open mouth of the case, the cap having a disk section defined by a separator ring having a reduced strength zone that encircles the disk section, wherein an outer circumference of the cap form a seat for receiving an edge of the open mouth.

In aspects, the present disclosure provides a perforating tool for perforating a wellbore tubular in a wellbore. The perforating tool may include a charge holder connected to a work string and a perforator fixed in a charge holder disposed along the work string. The perforator may include a cylindrical case having a bulkhead at a first end, an open mouth at a second end, and an interior volume, wherein the first end includes a post projecting therefrom, the post having a slot; an explosive material disposed in the interior volume; and a metal cap covering the open mouth of the case, the cap having a disk section defined by a separator ring, the separator ring having a structurally weakened zone that encircles the disk section. A detonating cord may be received in the slot of the post.

In aspects, the present disclosure also provides a method for perforating a wellbore tubular in a wellbore. The method may include the step of forming a work string by connecting a charge holder connected to the work string, disposing a detonating cord along the work string, and fixing a perforator in the charge holder. The method may also include the steps of conveying the work string into the wellbore; positioning the perforator in the wellbore tubular; and firing the shaped charge by detonating the detonating cord.

It should be understood that certain features of the invention have been summarized rather broadly in order that the detailed description thereof that follows may be better understood, and in order that the contributions to the art may be appreciated. There are, of course, additional features of the invention that will be described hereinafter and which will in some cases form the subject of the claims appended thereto.

BRIEF DESCRIPTION OF THE DRAWINGS

For detailed understanding of the present disclosure, references should be made to the following detailed description taken in conjunction with the accompanying drawings, in which like elements have been given like numerals and wherein.

DETAILED DESCRIPTION

Figure 1:
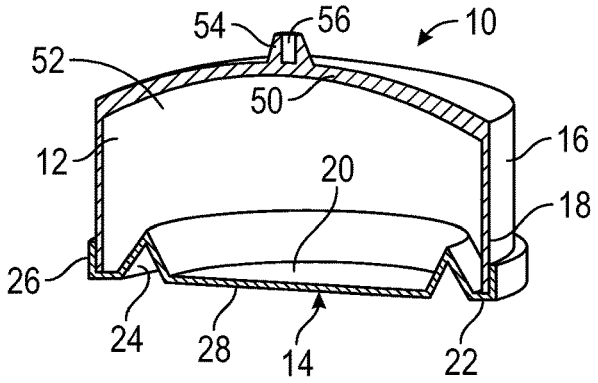
FIG. 1 illustrates an isometric side sectional view of a perforator in accordance with one embodiment of the present disclosure.

The present disclosure relates to devices and methods related to subsurface activity such as casing perforating, casing removal, completion, fishing operations to remove wellbore tubulars, etc. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Figure 2:
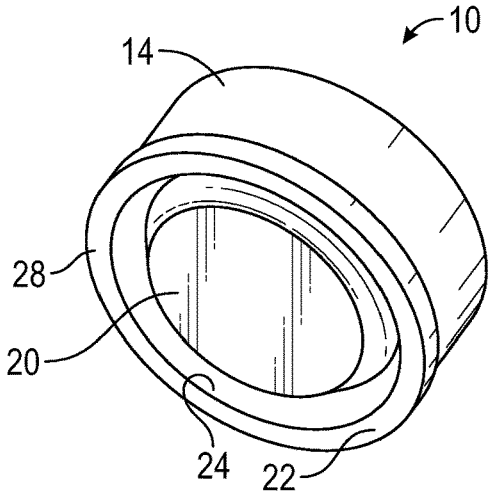
FIG. 2 illustrates an isometric view of the FIG. 1 perforator.

Referring to FIGS. 1 and 2, there is sectionally shown one embodiment of a shaped charge 10 in accordance with the present disclosure. The shaped charge 10 is designed to generate a large diameter projectile for puncturing, cutting, and/or severing a wellbore structure. The shaped charge 10 may include a case 12 and a cap 14. The case 12 may be formed as a cylindrical body 16 with a mouth 18 that is covered by the cap 14. A quantity of explosive material (not shown) may be disposed inside an interior volume 52 of the case 12, e.g., RDX, HMX and HNS.

The cap 14 is configured to generate a large diameter perforator which acts as a projectile that punctures, severs, cuts through, or otherwise perforates an adjacent structure. In one embodiment, the cap 14 includes a disk section 20 defined by a separator ring 22. An outer circumference 24 of the cap 14 may include a lip 26 in which an edge of the case 12 seats. The cap 14 has a face 28 that is formed of the surfaces defining the disk section 20 and the outer circumference 24. The face 28 may be configured to contact the wellbore structure to be cut or have a predetermined standoff or spacing from an adjacent surface.

The disk section 20 contains the material which forms the perforator. The cap 14 and/or disk section 20 may be formed from a powdered metal mixture that is compressed at high pressures to form a solid mass in the desired shape. A high density metal may be included in the mixture in order to achieve the desired effect from the explosive force. Common high density metals used include copper and tungsten, but other high density metals can also be used. The mixture of metals typically contains various other ductile metals being combined within the matrix to serve as a binder material. Other binder metals include nickel, lead, silver, gold, zinc, iron, tin, antimony, tantalum, cobalt, bronze, molybdenum and uranium.

Figure 2A:
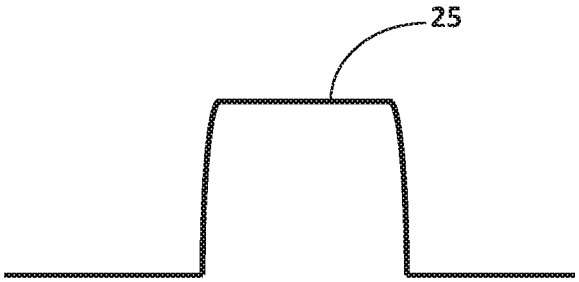
FIG. 2A illustrates a "U" shaped fold of a structurally weakened zone.

The disk section 20 may be generally flat and circular, but other geometric shapes may also be used (e.g., square or triangular). As used herein, the term "flat" is used as a contrast to a conical shape. However, in some embodiments, the flat disk section 20 may use a convex or concave arch to provide pressure integrity. The separator ring 22 is a portion of the cap 14 that is defined by a structurally weakened or reduced strength zone 24 that allows the disk section 20 to separate from the cap 14 when the explosives (not shown) inside the case 12 are detonated. A variety of mechanisms may be used to form the separator ring 22 in embodiments where the cap 14 is a single integral body. For example, a groove may be formed into the cap 14. Alternatively, as shown, a fold may be formed into the cap 14. The fold or groove may be "V" shaped, "U" shaped 25 (FIG. 2A), sinusoidal, a square shape, a rectangular, or any other shape having curved or straight sides that are suited for weakening the zone 24. In other embodiments, the separator ring 22 may have a reduced wall thickness section formed while the cap 14 is manufactured. In still other embodiments, the material at the separator ring 22 may be treated chemically to reduce strength. In yet other embodiments, the cap 14 may be an assembly of two or more discrete components; e.g., the disk section 20 may be a separate element.

Figure 3:
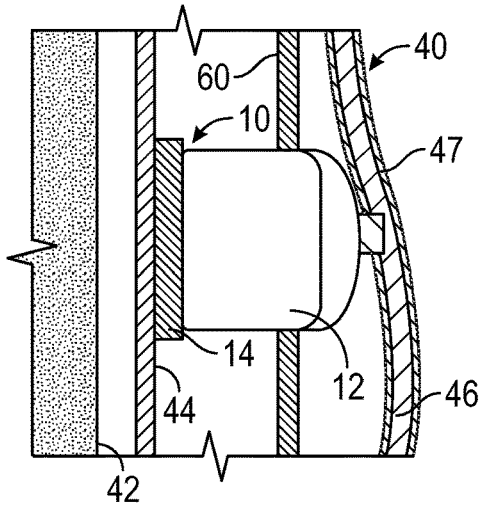
FIG. 3 illustrates a schematic side view of a well tool that uses the FIG. 1 perforator.

Referring to FIG. 3, there is shown a portion of a perforating tool 40 disposed in a wellbore 42. The perforating tool 40 includes a shaped charge 10 fixed in a charge holder 60 and positioned to be in intimate contact with a wellbore tubular 44. The charge holder may be a tube, strip, plate, or other structure that is shaped and configured to point the shaped charge 10 such that the disk section 20 can travel radially outward toward the wellbore tubular 44. By intimate contact, it is meant that at least a portion of the face 28 (FIG. 2) is in physical contact with the wellbore tubular 44. In embodiments, it may be desirable to have the face 28 parallel with the surface of the wellbore tubular 44. Thus, a majority of the disk section 20 has a surface that is parallel with the surface of the wellbore tubular 44 or, simply, the disk section 20 is substantially parallel with the wellbore tubular 44. When positioned as desired, a suitable firing system may be used to detonate the shaped charge 10. For instance, in one non-limiting embodiment, a detonating cord 46 may be used to detonate the explosive material (not shown) inside the shaped charge 10. Upon detonation, the disk section 22 breaks free of the cap 14 along the separator ring 22 and is propelled against the surface of the wellbore tubular 44. Once free of the cap 14, the disk section 20 functions as a perforator that cuts through the wellbore tubular 44.

In one non-limiting arrangement, the perforating tool 40 may be configured such that the shaped charge 10 is in physical contact with wellbore fluids. However, the explosive material inside the case 12 is isolated from contact with such liquids and gases as noted previously. In such embodiments, the charge holder 60 may be a strip or frame that does not enclose the charge holder 60. Also, the detonating cord 46 may be insulated in a pressure tubing 47 that protects the energetic material of the detonating cord 46 from exposure to the ambient wellbore environment (e.g., drilling fluids, fluid pressure, temperature, formation fluids, gases, etc.). Thus, the explosive material of the detonating cord 46 and the shaped charge 10 do not physically contact fluids in the wellbore such as liquids (e.g., drilling fluids, water, brine, liquid hydrocarbons) or gases (e.g., natural gas, etc.). A detonator (not shown) may be used to detonate the detonating cord 46, which then fires the shaped charge 10.

The teachings of the present disclosure may be used in connection with a variety of shaped charge configurations. As shown in FIG. 1, the case 12 may be configured as an encapsulated shaped charge. That is, the case 12 may include an unperforated bulkhead 50. By "unperforated," it is meant that there are no openings or passages through the case 12. A post 54 formed at the bulkhead 50 may include a channel 56 for receiving the detonating cord 46 and/or a booster material (not shown). However, the channel 56 may be "blind" in that it does not extend and communicate with the interior 52. Further, the engagement of the outer circumference 24 and the case 12 may also be fluid tight. Thus, the interior volume 52 of the shaped charge 10 may be hydraulically isolated from the ambient wellbore conditions. However, a conventional case, which has a channel, passage, or bore that does communicate with the interior of the case 12 may also be used.

Figure 4:
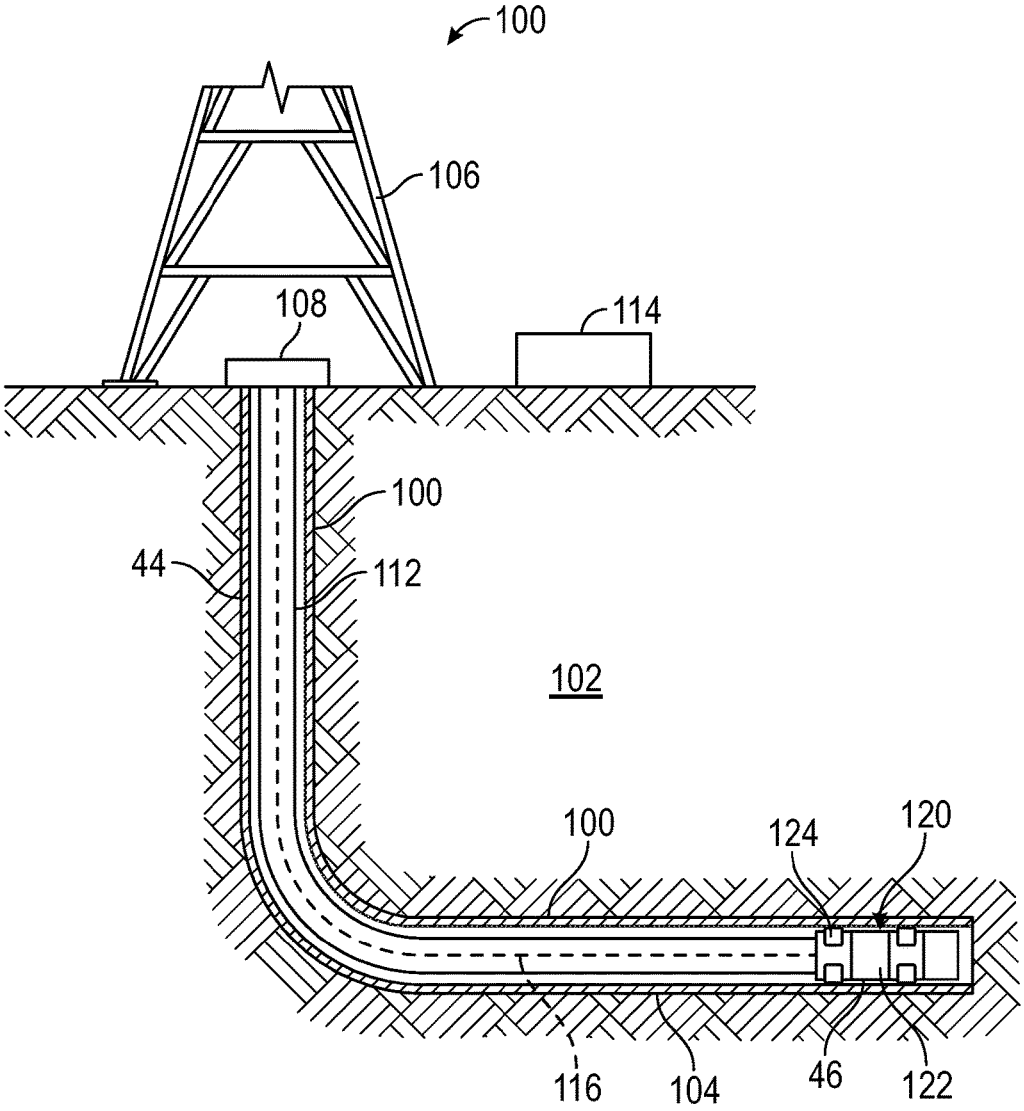
FIG. 4 illustrates a well in which perforators according to the present disclosure may be used.

Referring to FIG. 4, there is shown a well construction and/or hydrocarbon recovery facility 100 positioned over a subterranean formation of interest 102. The facility 100 can include known equipment and structures such as a rig 106, a wellhead 108, and casing or other wellbore tubular 44. A work string 112 is suspended within the wellbore 104 from the rig 106. The work string 112 can include drill pipe, coiled tubing, wire line, slick line, or any other known conveyance means. The work string 112 can include telemetry lines or other signal/power transmission mediums that establish one-way or two-way telemetric communication. A telemetry system may have a surface controller (e.g., a power source) 114 adapted to transmit electrical signals via a cable or signal transmission line 116 disposed in the work string 112. To perforate or sever equipment in the wellbore 104, the work string 112 may include a downhole tool 120 that as a perforating tool 122 that includes one or more shaped charges according to the present disclosure.

In one mode of use, the perforating tool 122 is positioned at a location 56 such that at least a portion of the face 28 (FIG. 2) of the shaped charge(s) 10 (FIG. 1) is in physical contact with the wellbore tubular 44. The wellbore tubular 44 may be casing, liner, drill string, production tubing, etc. In some embodiments, a positioning tool 124 may be used to position the perforating tool 122 inside the wellbore tubular 44. The positioning tool 122 may include arms, vanes, or other extendable elements that can contact an adjacent structure and push to the shaped charge 10 (FIG. 1) of the perforating tool 122 into contact with the wellbore tubular 44. The positioning tool 122 may use metal springs, inflatable packers, bladders, hydraulic fluid, or other mechanism to bias the extendable members into the extended position. Next, a firing signal from the controller 114 is used to detonate the shaped charge 10. Upon detonation, the disk section 20 (FIG. 2) cuts through the wellbore tubular 44 in a manner discussed previously.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. A perforating tool for perforating a wellbore tubular in a wellbore, comprising:

a work string;

a charge holder connected to the work string;

a shaped charge fixed in the charge holder, the shaped charge being configured to form a perforator that cuts through the wellbore tubular and having:

a cylindrical case having a bulkhead at a first end, an open mouth at a second end, and an interior volume, wherein the first end includes a post projecting therefrom, the post having a slot, the case being disposed in the charge holder, an explosive material disposed in the interior volume, and a metal cap covering the open mouth of the case, the cap having a disk section defined by a separator ring, the separator ring having a structurally weakened zone that encircles the disk section, the perforator being formed by the separation of the disk section from the metal cap at the structurally weakened zone upon detonation of the explosive material; and a detonating cord received in the slot of the post.

2. The perforating tool of claim 1, wherein the bulkhead is unperforated and a fluid tight seal is formed between the cap and the case to hydraulically isolate the interior volume of the case, and wherein the charge holder is a frame exposing the shaped charge and the detonating cord to a wellbore liquid.

3. The perforating tool of claim 1, further comprising a positioning tool disposed on the work string, the positioning tool configured to contact an adjacent wall and bias the a face of the cap against a surface of the wellbore tubular.

4. The perforating tool of claim 1, wherein the structurally weakened zone is formed by a fold.

5. The perforating tool of claim 4, wherein the fold is shaped as one of: (i) a "V", and (ii) a "U".

6. The perforating tool of claim 1, wherein the disk section is flat and the cap has an outer circumference includes a lip in which the case seats, wherein the structurally weakened zone is radially inward of the lip.

7. A perforating tool for perforating a wellbore tubular in a wellbore, comprising:

a cylindrical case having a bulkhead at a first end, an open mouth at a second end, and an interior volume, wherein the first end includes a post projecting therefrom, the post having a slot configured to receive a detonating cord;

an explosive material disposed in the interior volume;

a metal cap covering the open mouth of the case, the cap having a disk section defined by a separator ring, the separator ring having a structurally weakened zone that encircles the disk section; and a perforator formed by the separation of the disk section from the metal cap at the structurally weakened zone upon detonation of the explosive material.

8. The perforating tool of claim 7, wherein the bulkhead is unperforated and a fluid tight seal is formed between the cap and the case to hydraulically isolate the interior volume of the case.

9. The perforating tool of claim 7, wherein the structurally weakened zone is formed by a fold.

10. The perforating tool of claim 9, wherein the fold is shaped as one of: (i) a "V", and (ii) a "U".

11. The perforating tool of claim 7, wherein a majority of the disk section is flat.

12. The perforating tool of claim 7, wherein the structurally weakened zone is formed by at least one of: (i) a groove, (ii) and (iii) a reduced thickness section.

13. A method for perforating a wellbore tubular in a wellbore, comprising:

forming a work string by connecting a charge holder connected to the work string, disposing a detonating cord along the work string, and fixing a a shaped charge in the charge holder, the shaped charge having:

a cylindrical case having a bulkhead at a first end, an open mouth at a second end, and an interior volume, wherein the first end includes a post projecting therefrom, the post having a slot configured to receive the detonating cord;

an explosive material disposed in the interior volume; and a metal cap covering the open mouth of the case, the cap having a disk section defined by a separator ring, the separator ring having a structurally weakened zone that encircles the disk section;

conveying the work string into the wellbore;

positioning the shaped charge in the wellbore tubular;

firing the shaped charge by detonating the detonating cord; and forming a perforator from the disk section by separating the disk section from the metal cap at the structurally weakened zone upon the detonation of the explosive material.

14. The method of claim 13, further comprising exposing the shaped charge and the detonating cord to direct contact with a liquid in the wellbore.

* * * * *